United States Patent [19]

Blore

[11] 4,079,602

[45] Mar. 21, 1978

[54] LIMITED STRETCH DOUBLE KNIT FABRIC

[75] Inventor: James H. Blore, Mauldin, S.C.

[73] Assignee: Phillips Fibers Corporation, Greenville, S.C.

[21] Appl. No.: 769,821

[22] Filed: Feb. 17, 1977

[51] Int. Cl.[2] ..... D04B 1/14

[52] U.S. Cl. ..... 66/196; 66/202; 28/156

[58] Field of Search ..... 66/196, 202; 28/76 R, 28/156, 163

[56] References Cited

U.S. PATENT DOCUMENTS

| | | | |
|---|---|---|---|
| 2,789,340 | 4/1957 | Cresswell | 66/202 X |
| 3,115,693 | 12/1963 | Chandler | 28/156 |
| 3,167,941 | 2/1965 | Rab | 66/202 |
| 3,795,569 | 3/1974 | Pillen et al. | 66/202 X |
| 3,965,833 | 6/1976 | Frohlich et al. | 66/202 |

FOREIGN PATENT DOCUMENTS

| | | | |
|---|---|---|---|
| 646,494 | 4/1964 | Belgium | 66/202 |
| 7,023,846 | 2/1972 | France | 66/202 |
| 861,977 | 3/1961 | United Kingdom | 66/202 |
| 1,067,944 | 5/1967 | United Kingdom | 66/202 |

*Primary Examiner*—Louis K. Rimrodt
*Assistant Examiner*—Andrew M. Falik

[57] ABSTRACT

A double knit fabric is knitted from at least a first yarn and a second yarn, said first yarn having a boiling water shrinkage ranging from boiling water shrinkage ranging from about 50 to about 95 percent, and said fabric containing from about 70 to about 90 percent of the first yarn and about 10 to about 30 percent of the second yarn.

11 Claims, 2 Drawing Figures

LIMITED STRETCH DOUBLE KNIT FABRIC

BACKGROUND

The invention relates to a double knit fabric. In another aspect the invention relates to a double knit fabric having unusually low stretch properties. In still another aspect the invention relates to a double knit fabric suitable for use as an upholstery fabric.

It is well known that weft-knitted fabrics, and more particularly double knits have substantial stretching ability in both the course direction and the wale direction. Further, double knit fabrics have been very popular in clothing for both men and women, especially double knit fabrics made from polyesters. It is also well known that double knit fabrics have found only limited application in the upholstery market, although double knits in general are very long lasting and durable fabrics. Two major factors are believed to be the more significant reasons for the limited utilization of double knit fabrics in the upholstery industry. First double knit fabrics have the property of stretching in both the course and wale directions to a greater extent than is usually desirable in upholstery goods. Secondly, a large part of the double knit manufacturing capacity worldwide produces a finished fabric ranging in width from about 60 to about 62 inches; however, it is generally desirable for upholstery fabrics to have a width ranging from about 54 to about 56 inches. The double knit fabrics of the present invention not only have limited stretching capability in both the course and wale directions, but also said fabrics are capable of being produced in widths of 54 to 56 inches on machines now in use, and thus appear to be ideal for use as upholstery fabrics.

An object of the present invention is a double knit fabric having limited stretching properties in both the course and wale directions.

Another object of the invention is a double knit fabric having a finished width suitable for an upholstery fabric.

Another object of the invention is a double knit fabric having a finished width suitable for an upholstery fabric which is also capable of being produced on knitting machines currently in use.

Other objects, aspects and advantages of the invention will be apparent to one skilled in the art after studying the specification, drawings and the appended claims.

SUMMARY

According to the invention a double knit fabric is knitted from at least a first yarn and a second yarn wherein the first yarn has a boiling water shrinkage ranging from about 0 to about 20 percent as determined by ASTM Test D2259-71 and the second yarn has a boiling water shrinkage ranging from about 50 to about 95 percent as determined by the same test. The amount of the first yarn in the fabric of the invention ranges from about 70 to about 90 weight percent and the amount of the second yarn ranges from about 10 to about 30 weight percent. Such fabrics when treated under conditions to shrink the knitted fabric and then stretched and heat set produce a finished fabric having widths suitable for use as upholstery materials and a double knit fabric with limited stretching properties which is also desirable in a double knit fabric used as an upholstery material.

Detailed Description of the Invention

Figure 1:
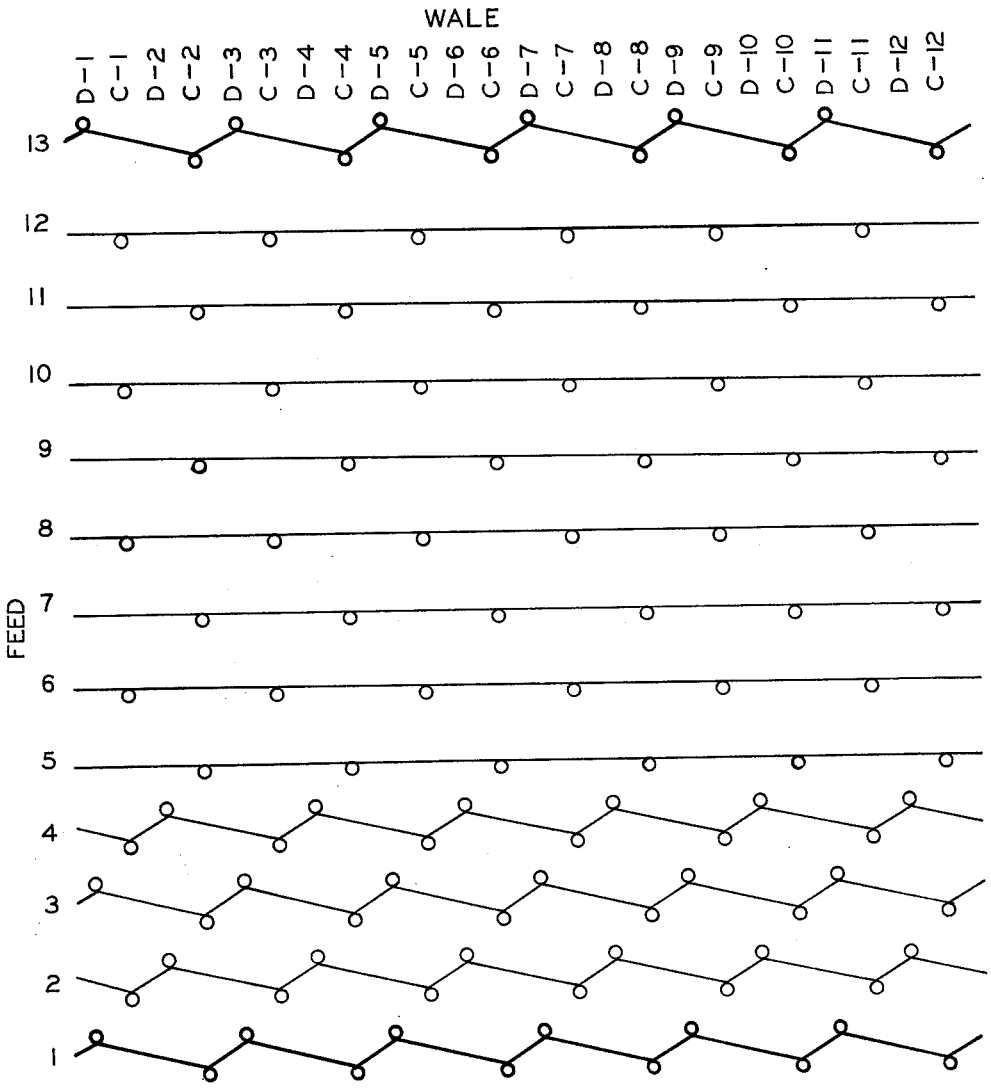
FIG. 1 is a needle diagram illustrating the stitching of one embodiment of a double knit fabric of the present invention.

At least two yarns having different properties are used to knit the fabrics of the invention. One yarn has a boiling water shrinkage ranging from about 0 to about 20 percent as determined by ASTM Test D2259-71. This yarn comprises from about 70 to about 90 percent by weight of the fabric. The other yarn has a boiling water shrinkage ranging from about 40 to about 95 percent as determined by ASTM Test D2259-71 and comprises from about 10 to about 30 percent by weight of the fabric. Generally the ratio of the courses of the yarn with the lower boiling water shrinkage to the courses of the yarn with the higher boiling water shrinkage ranges from about 5 to 1 to about 11 to 1, although most any ratio can be used. Since the yarn with the higher boiling water shrinkage is generally a weaker yarn as compared to the other yarn, the strongest fabric is one in which the use of the higher shrinkage yarn is kept to a minimum. Thus, the minimum amount of the high shrink yarn which will result in a finished fabric with low stretch properties in both the course and wale directions and with the desired width should be used.

Because of the requirement that the fabrics of the invention have good strength the more shrinkable yarn should not be knitted on more than about 80 percent of the cylinder and dial needles for any one course. Based upon good results obtained when the more shrinkable yarn was knitted on alternate cylinder and dial needles in any one course, i.e., 50 percent of the cylinder and dial needles, it is believed that very strong fabrics of the invention can be produced by knitting the more shrinkable yarn on a maximum of about 60 percent of the cylinder and dial needles for any one course.

With respect to the stretching properties of the finished fabric, the finished fabric of the present invention generally has a maximum stretch in the course direction of about 75 percent, a maximum stretch in the wale direction of about 25 percent, a maximum percent of set in the course direction of about 20 and a maximum percent of set in the wale direction of about 5 as determined by Ford Motor Company Test No. MF-MH BN4-1, "Stretch and Set of Textiles, Artificial Leather and Genuine Leather". However, fabrics of the present invention frequently are produced with a maximum stretch in the course direction of about 50 percent, a maximum stretch in the wale direction of about 15 percent, a maximum percent of set in the course direction of about 15 and a maximum percent of set in the wale direction of about 2 as determined by the above test. As used herein the term "finished fabric" means a double knit fabric that has been subjected to conditions to shrink the shrinkable yarns making up the fabric and the shrunken fabric is then stretched and heat set.

Yarns suitable for use in the invention include, for example, polyester, polyamides and polyolefins and generally these yarns will be used most often. Since the more shrinkable yarn used to produce the double knit fabrics of the present invention must have a shrinkability range beyond the range for most natural fibers, only synthetic yarns are normally used; however, a natural fiber yarn could be used as the less shrinkable yarn in making fabrics of the present invention. Such natural fiber yarns include, for example cotton and wool. Also blends of natural fibers and synthetic fibers can be used for the less shrinkable yarn.

One of the more common machines suitable for producing a double knit fabric according to the present invention is a 30 inch circular interlock 18 cut knitting machine although the fabrics of the present invention are not limited to a particular type or size of machine. Fabrics of the invention are treated to conditions suitable for shrinking the shrinkable yarns used to produce the double knit fabric. Procedures and conditions suitable for shrinking the yarns in the fabric such as for example dye baths, boiling water baths or steam treatments, are well known in art and do not constitute a part of the present invention. Fabrics of the invention produced on 30-inch circular machines either double knit or interlock machines after being subjected to the shrinkage treatment are generally about 44 to about 48 inches wide. These fabrics are then framed or stretched to approximately the desired width on a machine, such as a tenter frame, and then heat set. The fabric after the framing and heat setting steps, generally has a width ranging from about 54 to about 56 inches.

EXAMPLE

Figure 2:
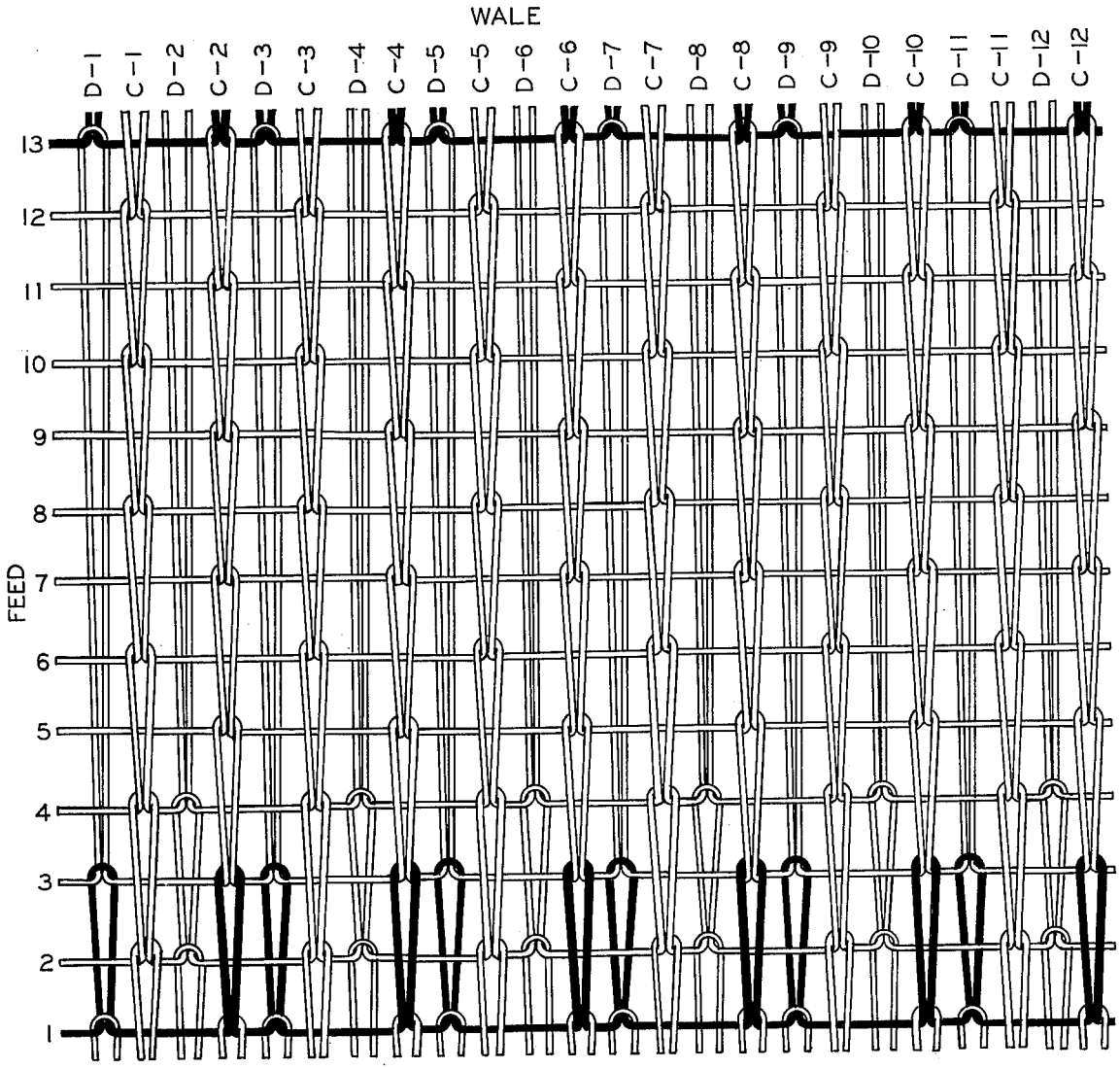
FIG. 2 is a stitch diagram corresponding to the needle diagram shown in FIG. 1.

A fabric of the invention was produced which is represented by the needle drawing and the stitch drawing of FIGS. 1 and 2, respectively. Both figures are shown 13 courses high and 24 wales wide. The first course was knitted using a high shrinkage yarn, which in this embodiment of the invention was a 230 denier, 34 continuous filament partially drawn polyester yarn having a boiling water shrinkage of approximately 55 to 60 percent as determined by ASTM Test D2259-71. The first course was knitted on the first dial needle, D1, then the second cylinder needle, C2, the third dial needle, D3, and then on alternate cylinder and dial needles C4, D5, C6, D7, C8, D9, C10, D11 and C12.

In courses 2 through 12 a 150 denier, 34 continuous multifilament drawn polyester yarn was used as the yarn of low shrinkability. This yarn had a boiling water shrinkage of about 5–10 percent as determined by ASTM Test D2259-71. In course 2 the yarn was knitted on alternate cylinder and dial needles beginning with cylinder needle C1 and dial needle D2. In course 3 the yarn was knitted the same as for course 1 except that the 150/34 yarn was used. In course 4 the yarn was knitted the same as for course 2. Course 5 was knitted on alternate cylinder needles only beginning with C2. In course 6 the yarn was knitted on alternate cylinder needles only beginning with C1. Courses 7, 9 and 11 are identical to course 5 and courses 8, 10 and 12 are identical to course 6; and then the courses are repeated starting with course 13.

The stitch diagram of FIG. 2, as illustrated from the face side of the fabric, shows that all of the stitches made by the cylinder needles are the same. Each wale made by the cylinder needles has stitches two courses long with the stitches in adjacent wales staggered by one course. The 230/34 yarn is shown as the shaded yarn and the 150/34 yarn is shown as the unshaded yarn.

The stitches made by the dial needles, as shown in FIG. 2, have a welt (miss-knit) stitch 2 courses long followed by another welt (miss-knit) stitch 10 courses long and the stitches of adjacent wales knitted by the dial needles are staggered one course with all the stitches knitted in the first and third courses knitted by the odd-numbered dial needles and all the stitches knitted in the second and fourth courses knitted by the even-numbered dial needles.

The fabric comprised approximately 14 percent by weight of the 230/34 partially drawn yarn, the high shrinkage yarn, and 86 percent by weight of the 150/34 fully drawn yarn, the low shrinkage yarn. The finished fabric had a width of 55 inches and a stretch of 43.6 percent in the course direction and a stretch of 13.3 percent in the wale direction, after recovery 10.6 percent of set in the course direction and after recovery a 0.8 percent of set in the wale direction as determined by Ford Motor Company Test No. MF-MH BN4-1, "Stretch and Set of Textiles, Artificial Leather and Genuine Leather".

Of course fabrics of the present invention can be produced with unlimited patterns and stitch designs provided the various parameters defining the shrinkage and weight of the yarns are satisfied.

What is claimed is:

1. A double knit fabric of limited stretch properties knitted from at least a first yarn and from a second yarn, said first yarn having a boiling water shrinkage ranging from about 0 to about 20 percent as determined by ASTM Test D2259-71 and said second yarn having a boiling water shrinkage ranging from about 40 to about 95 percent as determined by said test, said fabric comprising from about 70 to about 90 percent of said first yarn by weight and from about 10 to about 30 percent of said second yarn by weight.

2. A double knit fabric of limited stretch properties produced on a knitting machine having cylinder and dial needles and knitted from at least a first yarn and from a second yarn, said first yarn having a boiling water shrinkage ranging from about 0 to about 20 percent as determined by ASTM Test D2259-71 and said second yarn having a boiling water shrinkage ranging from about 40 to about 95 percent as determined by said test, said fabric comprising from about 70 to about 90 percent of said first yarn by weight and from about 10 to about 30 percent of said second yarn by weight and wherein said second yarn is knitted on a maximum of about 80 percent of the cylinder and dial needles for any one course.

3. The double knit fabric of claim 1 produced on a knitting machine having cylinder and dial needles wherein said second yarn is knitted on a maximum of about 60 percent of the cylinder and dial needles for any one course.

4. The double knit fabric of claim 1 produced on a knitting machine having cylinder and dial needles wherein any one course of said second yarn is knitted substantially on alternating cylinder needles and substantially on alternating dial needles.

5. The double knit fabric of claim 1 which is subjected to conditions suitable for shrinking the yarns and the shrunken fabric is then stretched and heat set to produce a fabric of the desired width.

6. The double knit fabric of claim 5 wherein the stretched and heat set fabric has a maximum stretch in the course direction of about 75 percent, a maximum stretch in the wale direction of about 25 percent, a maximum percent of set in the course direction of about 20 and a maximum percent of set in the wale direction of about 5 as determined by Ford Motor Company Test No. MF-MH BN4-1.

7. The double knit fabric of claim 5 wherein the stretched and heat set fabric has a maximum stretch in the course direction of about 50 percent, a maximum stretch in the wale direction of about 15 percent, a maximum percent of set in the course direction of about 15 and a maximum percent of set in the wale direction of about 2 as determined by Ford Motor Company Test No. MF-MH BN4-1.

8. The double knit fabric of claim 5 which is produced on a 30-inch circular knitting machine is shrunk to a width ranging from about 44 to about 48 inches and then stretched and heat set to produce a fabric having a width ranging from about 54 to about 56 inches.

9. The double knit fabric of claim 1 wherein the first and second yarns are selected from the group consisting of polyesters, polyolefins, polyamides and mixtures thereof.

10. The double knit fabric of claim 1 wherein the first yarn is a fully oriented polyester yarn and the second yarn is a partially oriented polyester yarn.

11. The fabric of claim 1 wherein the ratio of the courses of the first yarn to the courses of the second yarn ranges from about 5 to 1 to about 11 to 1.

* * * * *

UNITED STATES PATENT AND TRADEMARK OFFICE

CERTIFICATE OF CORRECTION

PATENT NO. : 4,079,602
DATED : March 21, 1978
INVENTOR(S) : James H. Blore

It is certified that error appears in the above-identified patent and that said Letters Patent are hereby corrected as shown below:

Column 4, lines 49, 54 and 59, "1" should read --- 2 ---.
Column 6, lines 3, 7 and 10, "1" should read --- 2 ---.

Signed and Sealed this

*Fifth* Day of *September 1978*

[SEAL]

*Attest:*

RUTH C. MASON
*Attesting Officer*

DONALD W. BANNER
*Commissioner of Patents and Trademarks*